US009952531B2

(12) United States Patent
Ishii et al.

(10) Patent No.: US 9,952,531 B2
(45) Date of Patent: Apr. 24, 2018

(54) DEVELOPING MEMBER HAVING ALUMINA PARTICLES EXPOSED WITHIN PROTRUSIONS

(71) Applicant: CANON KABUSHIKI KAISHA, Tokyo (JP)

(72) Inventors: Toru Ishii, Mishima (JP); Minoru Nakamura, Mishima (JP); Hiroshi Morishita, Suntou-gun (JP); Kenta Matsunaga, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/486,688

(22) Filed: Apr. 13, 2017

(65) Prior Publication Data

US 2017/0315469 A1 Nov. 2, 2017

(30) Foreign Application Priority Data

Apr. 28, 2016 (JP) ..... 2016-091000

(51) Int. Cl.
*G03G 15/08* (2006.01)

(52) U.S. Cl.
CPC ..... *G03G 15/0808* (2013.01); *G03G 15/0818* (2013.01); *G03G 2215/0861* (2013.01)

(58) Field of Classification Search
CPC ..... G03G 15/0808; G03G 15/0818; G03G 15/0861
USPC ..... 399/286
See application file for complete search history.

(56) References Cited

U.S. PATENT DOCUMENTS

| | | | | |
|---|---|---|---|---|
| 5,741,616 | A * | 4/1998 | Hirano | G03G 15/0818 399/286 |
| 7,356,293 | B2 | 4/2008 | Mizumoto | |
| 7,727,134 | B2 | 6/2010 | Nakamura et al. | |
| 7,797,833 | B2 | 9/2010 | Nakamura et al. | |
| 7,798,948 | B2 | 9/2010 | Kawamura et al. | |
| 7,799,398 | B2 | 9/2010 | Nakamura et al. | |
| 8,600,273 | B2 | 12/2013 | Yamada et al. | |
| 8,655,222 | B2 | 2/2014 | Nakamura et al. | |
| 8,706,011 | B2 | 4/2014 | Anan et al. | |
| 8,768,227 | B2 | 7/2014 | Urushihara et al. | |
| 8,798,508 | B2 | 8/2014 | Yamada et al. | |
| 8,874,007 | B2 | 10/2014 | Kawamura et al. | |
| 8,913,930 | B2 | 12/2014 | Ishii et al. | |
| 8,965,254 | B2 | 2/2015 | Ogawa et al. | |
| 9,261,811 | B2 | 2/2016 | Hagiwara et al. | |

(Continued)

FOREIGN PATENT DOCUMENTS

| | | |
|---|---|---|
| EP | 3 026 495 | 6/2016 |
| JP | 2002-070839 | 3/2002 |

(Continued)

*Primary Examiner* — Billy Lactaoen
(74) *Attorney, Agent, or Firm* — Fitzpatrick Cella Harper and Scinto

(57) ABSTRACT

The present disclosure provides developing member superior in triboelectric charge imparting ability to a toner. The developing member includes a substrate and a surface layer, the surface layer containing alumina particles and a resin, the surface layer having protrusions on the surface thereof. Each of the protrusions containing the alumina particles, part or all of the alumina particles being exposed at the surfaces of the protrusions, and the resin being interposed among the alumina particles.

7 Claims, 5 Drawing Sheets

(56) References Cited

U.S. PATENT DOCUMENTS

| | | | | |
|---|---|---|---|---|
| 9,625,854 | B2 | 4/2017 | Koyanagi et al. | |
| 2008/0220363 | A1* | 9/2008 | Uchino | G03G 15/0818 430/125.5 |
| 2012/0294656 | A1 | 11/2012 | Egawa et al. | |
| 2015/0003872 | A1* | 1/2015 | Taniguchi | G03G 15/0233 399/176 |
| 2016/0033894 | A1 | 2/2016 | Tokiwa et al. | |
| 2017/0115595 | A1 | 4/2017 | Nakamura et al. | |
| 2017/0139336 | A1 | 5/2017 | Nagaoka et al. | |

FOREIGN PATENT DOCUMENTS

| | | |
|---|---|---|
| JP | 2006-163205 | 6/2006 |
| JP | 2008-304787 | 12/2008 |
| JP | 2012-014065 | 1/2012 |
| JP | 2015-094897 | 5/2015 |

* cited by examiner

DEVELOPING MEMBER HAVING ALUMINA PARTICLES EXPOSED WITHIN PROTRUSIONS

BACKGROUND OF THE INVENTION

Field of the Invention

The present disclosure relates to a developing member included in apparatuses using electrophotography, such as copiers, printers, or receivers of fax machines, the developing member being brought into contact with or adjacent to an image carrier in use. The present disclosure also relates to a process cartridge and an electrophotographic image forming apparatus.

Description of the Related Art

In the process of forming electrophotographic images in electrophotographic apparatuses, developing members deliver toners to regions to be developed, and impart triboelectric charge to the toners. Insufficient charging amounts of the toners can be a cause of generation of fogging in the electrophotographic images. Therefore, a further enhancement in image quality requires developing members having a further enhanced ability to impart triboelectric charge to the toners. Japanese Patent Application Laid-Open Nos. 2015-094897 and 2006-163205 disclose developing members each using alumina in a surface layer, and having enhanced ability to impart triboelectric charge to toners.

SUMMARY OF THE INVENTION

One aspect of the present disclosure is directed to providing a developing member superior in triboelectric charge imparting ability to a toner. Another aspect of the present disclosure is directed to providing a process cartridge and an electrophotographic image forming apparatus which contributes to stably forming electrophotographic images with high quality.

According to the present disclosure, there is provided a developing member comprising a substrate and a surface layer, the surface layer containing alumina particles and a resin, the developing member having protrusions on the surface thereof, each of the protrusions containing the alumina particles, part or all of the alumina particles contained in each of the protrusions being exposed at a surface of each of the protrusions, and the resin being interposed among the alumina particles contained in each of the protrusions.

According to another aspect of the present disclosure, there is provided an electrophotographic process cartridge detachably mountable on a main body of the electrophotographic apparatus, and including the aforementioned developing member.

According to further aspect of the present disclosure, there is provided an electrophotographic image forming apparatus including an image carrier for carrying an electrostatic latent image, a charging apparatus for primarily charging the image carrier, an exposing apparatus for forming an electrostatic latent image on the image carrier primarily charged, a developing member for developing the electrostatic latent image with a toner to form a toner image, and a transfer apparatus for transferring the toner image onto a transfer material, wherein the developing member is the aforementioned developing member.

Further features of the present disclosure will become apparent from the following description of exemplary embodiments with reference to the attached drawings.

DESCRIPTION OF THE EMBODIMENTS

Preferred embodiments of the present disclosure will now be described in detail in accordance with the accompanying drawings.

The present inventors have examined the developing members disclosed in Japanese Patent Application Laid-Open Nos. 2015-094897 and 2006-163205 and have found that in some cases, the toners were not sufficiently charged when the number of sheets printed was increased. Such a reduction in the ability to impart triboelectric charge to the toner is remarkable when the friction of the developing member with a toner feeding roller and a toner regulating member occurs highly frequently, specifically, in electrophotographic image forming apparatuses having a high process speed, for example.

Then, the present inventors have examined the reason why the ability to impart triboelectric charge to the toner was reduced when the developing members according to Japanese Patent Application Laid-Open Nos. 2015-094897 and 2006-163205 were used to form a large number of electrophotographic images. As a result, the present inventors have considered that after long-term use of the developing member, alumina dropped off from the surface of the developing member, and the toner adhering to the surface of the developing member contaminated the surface of the developing member, thus reducing the triboelectric charge imparting ability of the developing member.

The present inventors, conducted further research based on such consideration, have found that a developing member can retain a superior triboelectric charge imparting ability even after long-term use when the surface of the developing member has protrusions formed of a plurality of alumina particles and a resin is interposed among the alumina particles contained in each of the protrusions.

According to one aspect of the present disclosure, a developing member in the form of a roller (hereinafter, also referred to as "developing roller") will now be described. The developing member according to one aspect of the present disclosure can be in any form in addition to the roller.

Figure 1:
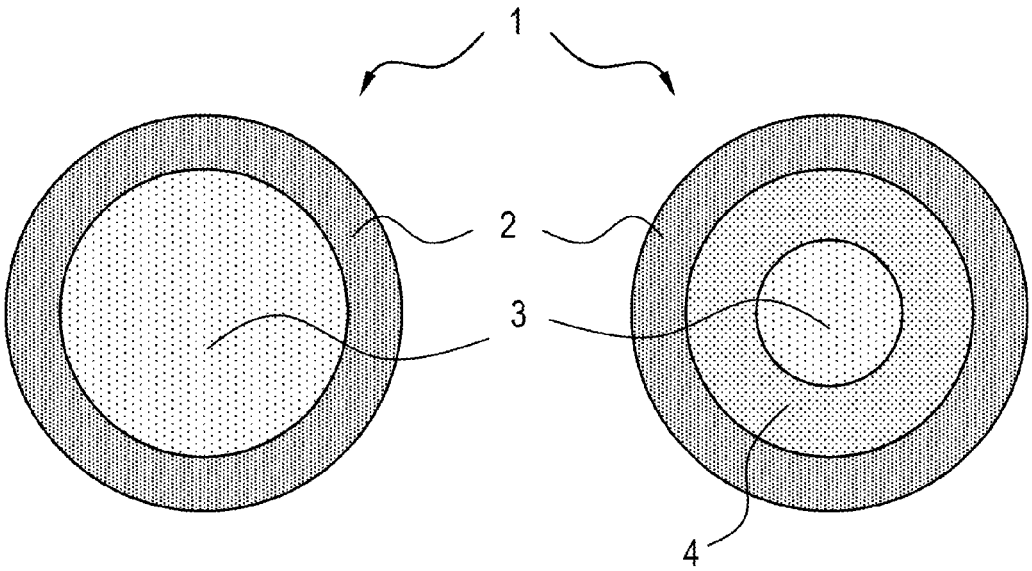
FIG. 1 is a conceptual diagram illustrating an example of the developing member according to the present disclosure.

FIG. 1 is a sectional view of the developing roller according to one aspect of the present disclosure orthogonal to the axis of rotation. A developing roller 1 illustrated in FIG. 1 includes a surface layer 2 on the outer peripheral surface of a core of the shaft as a substrate 3. One or a plurality of functional layers may be disposed between the substrate 3 and the surface layer 2 when necessary. For example, a developing member including an elastic layer 4 disposed between the substrate 3 and the surface layer 2 is suitably used in a non-magnetic one-component contact developing process.

Figure 2:
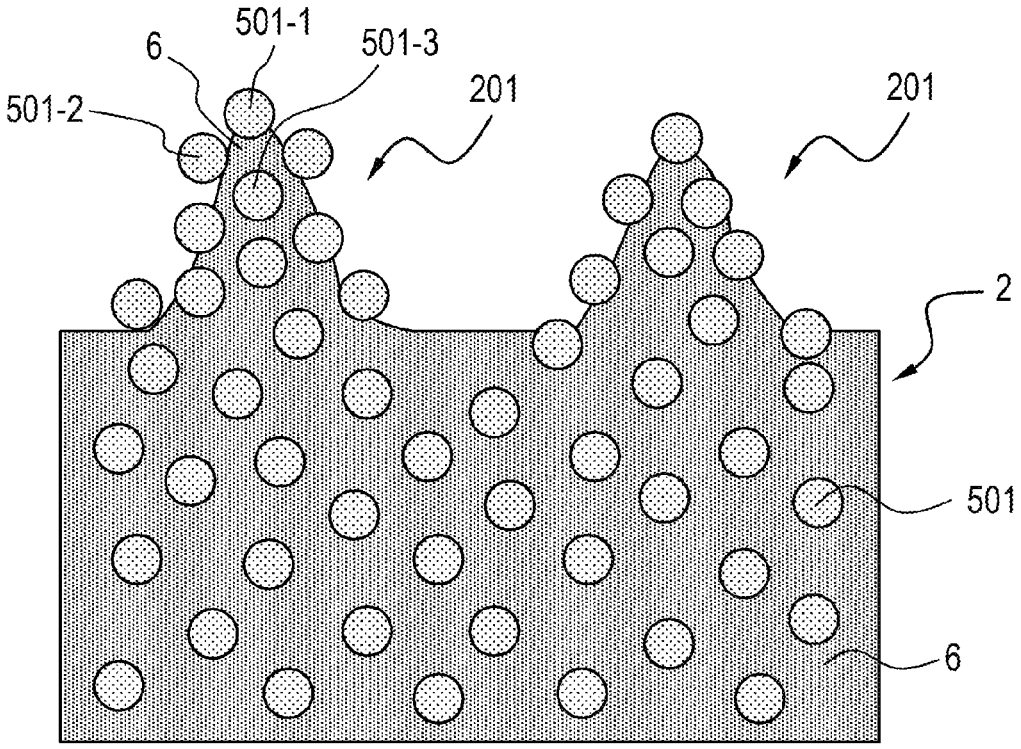
FIG. 2 is a sectional view illustrating part of a surface layer of the developing member according to the present disclosure.

FIG. 2 illustrates a cross-section of part of the surface layer 2 in the developing roller 1. The surface layer 2 contains alumina particles 501 and a resin 6. The developing roller 1 has protrusions 201 on the surface. Each of the protrusions 201 contains alumina particles 501, and at least part of the plurality of alumina particles 501 contained in each of the protrusions 201 is exposed at the surface of each of the protrusions 201. In FIG. 2, alumina particles 501-1 and 501-2 are exposed at the surface of the protrusions 201, for example. The resin 6 is interposed among the alumina particles 501 contained in the protrusions 201. In FIG. 2, the resin 6 is interposed in the alumina particles 501-1 and 501-2. The resin 6 is also interposed in the alumina particles 501-1 and 501-2 and an alumina particle 501-3 not exposed at the surface of the protrusions 201.

The present inventors consider the reason for that the developing member having such a configuration has the aforementioned advantages as follows.

In the method disclosed in Japanese Patent Application Laid-Open No. 2015-094897, because alumina particles are only applied onto the surface of the developing member and dried, the alumina particles adhere to the surface of the developing member with a small adhesive force. Therefore, the alumina particles readily drop off during a repeating process to print images. The triboelectric charge imparting ability of the developing member after long-term use readily reduces with the drop-off of the alumina particles.

In the developing member disclosed in Japanese Patent Application Laid-Open No. 2006-163205 in which alumina particles are dispersed in rubber, a small amount of alumina particles is exposed at the outermost surface of the developing member, and protrusions derived from alumina particles are not formed. Therefore, the surface of the developing member is readily contaminated with the toner during the repeating process to print images, and the alumina particles may be embedded in the contaminants. As a result, the triboelectric charge imparting ability of the developing member readily reduces after long-term use of the developing member.

In contrast, the resin is interposed among the alumina particles on the surface layer of the developing member according to one aspect of the present disclosure. The resin interposed among the alumina particles increases the adhesive force between the alumina particles and the developing member, firmly retaining the alumina particles on or in the surface layer of the developing member. As a result, the alumina particles barely drop off from the surface layer even after long-term use of the developing member and are retained on or in the surface of the developing member.

Moreover, in the developing member according to one aspect of the present disclosure, the surface of the developing member has protrusions containing alumina particles. Such protrusions delivers strong friction of the toner mainly near the vertices of the protrusions. Therefore, the contamination of the surface of the developing member by the toner can be minimized. Accordingly, the embedding of the alumina particles caused by contamination by the toner can be prevented even after long-term use of the developing member according to the present disclosure.

Furthermore, it is considered that the alumina particles are exposed at the side surfaces of such protrusions as illustrated in FIG. 2. Therefore, the absolute number of alumina particles present at the surface of the developing member increases, and thus the frequency of contact between the alumina particles and the toner particles increases. For these reasons, it is inferred that the triboelectric charge imparting ability of the developing member according to one aspect of the present disclosure barely reduces even after long-term use.

[Substrate]

In the case of a developing roller, the substrate has a cylindrical or hollow cylindrical shape, for example. Examples of the material for the substrate include metals or alloys such as aluminum, copper alloys, and stainless steel; iron plated with chromium or nickel; and synthetic resins having electro-conductivity. An adhesive layer may be disposed on the surface of the substrate to enhance the adhesiveness to the elastic layer or the surface layer disposed as the outer periphery of the substrate.

[Elastic Layer]

A developing member including an elastic layer disposed between the substrate and the surface layer is suitably used in the non-magnetic one-component contact developing process. The elastic layer gives hardness and elasticity to the developing member. This hardness and elasticity allow the developing member to be pressed against an image carrier with an appropriate nip width and nip pressure such that a suitable amount of toner can be fed to an electrostatic latent image formed on the surface of the image carrier. The elastic layer can be typically formed of a molded article of a rubber material.

Examples of the rubber material include the following: ethylene-propylene-diene copolymerized rubber (EPDM), acrylic nitrile-butadiene rubber (NBR), chloroprene rubber (CR), natural rubber (NR), isoprene rubber (IR), styrene-butadiene rubber (SBR), fluorocarbon rubber, silicone rubber, epichlorohydrin rubber, hydrides of NBR, and urethane rubber.

These rubber materials may be used alone or in combination. Among these rubber materials, particularly, silicone rubber can be used because the silicone rubber barely generates compression set in the elastic layer even if another member (such as a toner regulating member) is brought into contact with the developing member over a long period of time. Examples of the silicone rubber specifically include cured products of addition-curable silicone rubber.

The elastic layer may be a conductive elastic layer of which the rubber material contains a conductive agent, such as an electronically conductive substance or an ionically conductive substance. The conductive elastic layer preferably has a volume resistivity of $1\times10^{3}$ Ω·cm or more and $1\times10^{11}$ Ω·cm or less. Particularly, the conductive elastic layer more preferably has a volume resistivity of $1\times10^{4}$ Ω·cm or more and $1\times10^{10}$ Ω·cm or less.

Examples of the electronically conductive substance include the following substances: conductive carbon, for example, carbon black, such as ketjenblack EC and acetylene black; carbons for rubber, such as SAF, ISAF, HAF, FEF, GPF, SRF, FT, and MT; carbon for color (ink) subjected to an oxidation treatment; and metals, such as copper, silver, and germanium, and metal oxides thereof. Among these electronically conductive substances, conductive carbons can be used because electro-conductivity is readily controlled with a small amount thereof.

Examples of the ionically conductive substance include the following substances: ionically conductive inorganic substances, such as sodium perchlorate, lithium perchlorate, calcium perchlorate, and lithium chloride; and ionically conductive organic substances, such as modified aliphatic dimethylammonium ethosulfate and stearylammonium acetate.

These conductive agents are used in an amount needed to control the conductive elastic layer to have an appropriate volume resistivity. The conductive agent is usually used in the range of 0.5 parts by mass or more and 50 parts by mass or less relative to 100 parts by mass of a binder resin.

When necessary, the conductive elastic layer can further contain a variety of additives, such as a plasticizer, a filler, an extender, a vulcanizing agent, a vulcanizing aid, a cross-linking aid, a curing suppressor, an antioxidant, an anti-aging agent, and a treatment aid. Examples of the filler include silica, quartz powder, and calcium carbonate. These optional components are compounded in amounts within the ranges not inhibiting the functions of the conductive elastic layer.

The elastic layer has elasticity required for the developing member. The elastic layer can have an asker C hardness of 20 degrees or more and 80 degrees or less, and have a thickness of 0.3 mm or more and 6.0 mm or less.

The materials for the elastic layer can be mixed using a dynamic mixing machine, such as a monoaxial continuous kneader, a biaxial continuous kneader, a two-roll, a kneader mixer and a trimix, or a static mixing machine, such as a static mixer.

The elastic layer can be formed on the substrate by any method without particular limitation. Examples thereof include methods, such as molding, extrusion molding, injection molding, and application molding. Examples of the molding include a method, in which pieces for holding a substrate in a cylindrical metal mold are first fixed to both ends of the metal mold; an inlet is formed in each of the pieces; the substrate is then disposed inside the metal mold; a material for the elastic layer is injected from the inlets; the metal mold is heated at a temperature at which the material cures; and an article is removed from the metal mold. Examples of the extrusion molding include a method in which a substrate and a material for an elastic layer are co-extruded from a crosshead extruder, and the material is cured to form an elastic layer around the substrate.

The surface of the elastic layer can be modified by surface polishing or a surface modification method, such as a corona treatment, a flame treatment, or an excimer treatment, to enhance the adhesion to the surface layer.

[Surface Layer]

The surface layer contains a resin and alumina particles. Moreover, the surface layer has protrusions, and each of the protrusions contains alumina particles. Moreover, part or all of the alumina particles contained in each of the protrusions is exposed at a surface of each of the protrusions. Further, the resin is interposed among the alumina particles contained in each of the protrusions.

[Resin]

Examples of the resin contained in the surface layer include the following resins: polyamide resins, nylon resins, polyurethane resins, urea resins, polyimide resins, melamine resins, fluorinated resins, phenol resins, alkyd resins, polyester resins, polyether resins, acrylic resins, and mixtures thereof. Among these resins, nitrogen-containing resins containing nitrogen atoms in their structures can be used because the acid-base interaction between the resin and the surfaces of the alumina particles can prevent drop-off of the alumina particles.

Particularly the polyurethane resins are more preferred because these resins have high flexibility, and thus are suitable for diffusing external stress. The polyurethane resins can be prepared using polyol and isocyanate, and when necessary, a chain extender can be applied. Examples of the polyol as a raw material for the polyurethane resin include polyether polyol, polyester polyol, polycarbonate polyol, polyolefin polyol, acrylic polyol, and mixtures thereof. Examples of the isocyanate as a raw material for the polyurethane resin include the following: tolylene diisocyanate (TDI), diphenylmethane diisocyanate (MDI), naphthalene diisocyanate (NDI), tolidine diisocyanate (TODI), hexamethylene diisocyanate (HDI), isophorone diisocyanate (IPDI), phenylene diisocyanate (PPDI), xylylene diisocyanate (XDI), tetramethylxylylene diisocyanate (TMXDI), cyclohexane diisocyanate, and mixtures thereof. Examples of the chain extender as a raw material for the polyurethane resin include bifunctional low molecular diols, such as ethylene glycol, 1,4-butanediol, and 3-methylpentanediol; trifunctional low molecular triols, such as trimethylolpropane; and mixtures thereof.

[Alumina Particles]

The following alumina particles (i) and (ii), for example, are suitably used.

(i) particles of aluminum oxides, such as α-alumina and γ-alumina; and particles of aluminum oxide hydrates, such as boehmite and pseudo-boehmite; and (ii) particles of aluminum hydroxide; and particles of aluminum compounds prepared through a hydrolysis or condensation reaction of aluminum alkoxide.

The particle can have any shape without particular limitation. Examples of the shape include spherical, elliptical, needle-like, plate-like, and polyhedral shapes. Spherical particles can be used in terms of preventing drop-off of the alumina particles. The term "spherical particles" used in the specification refers to particles including 95% or more of the total alumina particles having an aspect ratio in the range of 1.0 or more and 1.1 or less, which is determined from observation of 500 or more alumina particles with a transmission electron microscope. The term "aspect ratio" refers to an index calculated from Calculation expression (1) using the maximum long diameter Lm of each particle and the maximum width Wm orthogonal to the maximum long diameter determined through observation with an electron microscope.

aspect ratio=(maximum long diameter *Lm*)/(maximum width *Wm* orthogonal to maximum long diameter) Calculation expression (1)

Moreover, the alumina particles preferably has an average particle diameter of 100 nm or less in terms of efficiently imparting triboelectric charge to the toner. Furthermore, the alumina particles particularly preferably has an average particle diameter in the range of 20 nm or more and 50 nm or less in terms of retaining the triboelectric charge imparting ability by preventing drop-off of the alumina particles or wear of the protrusions. It is considered that alumina particles having an average particle diameter of 50 nm or less increase the surface area per unit mass of the alumina particles present in the protrusions of the surface layer of the developing member to enhance the interaction between the alumina particles or the interaction between the alumina particles and the resin, thus more significantly preventing drop-off of the alumina particles. Alumina particles having an average particle diameter of 20 nm or more can prevent a reduction in bonding force of the resin binding to the alumina particles in the protrusions, thus facilitating prevention of wear of the protrusions.

The term "average particle diameter" used in the specification refers to an arithmetic average value determined through observation with a transmission electron microscope by photographing 500 or more alumina particles at random, and measuring the diameters of these particles. In the measurement of the diameters, the average of the maximum long diameter Lm of a particle and the maximum width Wm orthogonal to the maximum long diameter is defined as the diameter of the particle. Using this average, the average particle diameter is calculated.

The particle diameter distribution of the alumina particles has a coefficient of variation of preferably 1.5 or less, more preferably 0.80 or less in terms of preventing drop-off of the alumina particles and enhance the triboelectric charge imparting ability of the developing member. This is probably because when alumina particles have a particle diameter distribution closer to monodispersion and alumina particles have more homogeneous, alumina particles bind to the resin uniformly in the protrusions formed of the alumina particles, and thus external stress is diffused uniformly without concentrating the external stress on a single point of the particle. Moreover, it is considered that alumina particles having a coefficient of variation within the above range are readily uniformly exposed at the entire surfaces of the protrusions, thus enhancing the ability to impart triboelectric charge to the toner. The term "coefficient of variation" used herein refers to a dimensionless index calculated from Calculation expression (2) below. Complete monodispersion has a coefficient of variation of 0.

coefficient of variation=(standard deviation of diameter σ)/(average particle diameter $D_M$) Calculation expression (2)

The alumina particles are used in an amount in the range of preferably 1.5 parts by mass or more and 350 parts by mass or less, more preferably 3.0 parts by mass or more 200 parts by mass or less relative to 100 parts by mass of the resin in view of the triboelectric charge imparting ability and the mechanical strength of the surface layer. Moreover, the surface of the surface layer has an atomic concentration of aluminum of 1.50 atomic % or more and 10.0 atomic % or less, because the ability to impart triboelectric charge to the toner can be more significantly enhanced, and the developing member after long-term use can retain a higher triboelectric charge imparting ability. The method of measuring the atomic concentration of aluminum will be described later.

[Protrusions Disposed on Surface of Developing Member]

The developing member has a plurality of protrusions on the surface. The protrusions can have a height of 0.02 μm or more and 3.0 μm or less. The density of the protrusions can be 1 protrusion/$\mu m^2$ or more and 100 protrusions/$\mu m^2$ or less. The irregularities generated by the protrusions have an average height Rc (the same meaning as that of the average height of a contour curve element described in JIS B 0601:2013) of preferably 0.05 μm or more and 2.20 μm or less in terms of retaining the triboelectric charge imparting ability of the developing member after the long-term use. Moreover, the average height Rc is more preferably 0.10 μm or more and 2.00 μm or less in some embodiments.

[Measurement of Atomic Concentration of Aluminum]

The atomic concentration of aluminum described above is measured through the following operations (1) to (3). That is, the atomic concentration of aluminum can be determined through photographing of the outermost surface of the developing member with a field emission scanning electron microscope (trade name: JSM-7800F, made by JEOL, Ltd.), and elemental analysis of the photographed outermost surface with an X-ray microanalysis system (trade name: NORAN System 7, made by Thermo Fisher Scientific Inc.).

(1) Preparation of Sample

The surface layer was cut into a 3 mm square (thickness is 1.0 mm, or the thickness is equal to at least the thickness of the surface layer or more if the total thickness of the elastic layer and the surface layer of the developing member is 1.0 mm or less) with a razor so as not to damage the outermost surface of the surface layer of the developing member. The cut piece is used as a sample for measurement. In the next step, a thin layer of conductive paste is applied onto an aluminum sample base (12.5 mm in diameter×5 mm in height). The sample is placed on the base such that the outermost surface of the sample faces upward. The sample base is set on a sample holder (12.5 mm).

(2) Acquiring Image with Field Emission Scanning Electron Microscope

For observation and analysis with the field emission scanning electron microscope, the degrees of vacuum of the chambers of the field emission scanning electron microscope are controlled to be predetermined values or less, respectively. Namely, the degree of vacuum of an electron gun chamber (SIP-1) is controlled to be $5.0\times10^{-7}$ Pa or less, the degree of vacuum of an intermediate chamber (SIP-2) disposed to prevent deterioration of the degree of vacuum of the electron gun chamber is controlled to be $1.0\times10^{-4}$ Pa or less, and the degree of vacuum of a sample chamber is controlled to be $1.0\times10^{-3}$ Pa or less.

The sample holder is inserted into the sample chamber in the housing of the field emission scanning electron microscope. The Z-axis of the stage is moved such that the working distance (WD) is 10 mm. A lower detector (LED) is specified as a detector. When the sample holder is moved into a position for observation, an accelerating voltage of 10 kV is applied, and a current setting value is set at 8 (in the scale of the apparatus). The scan mode is set at fine 1. The focus, the brightness and the contrast are adjusted at a magnification of 500× to obtain an image of the outermost surface of the sample at any measured point.

(3) Elemental Analysis with X-Ray Microanalysis System

Next, the measured image is taken into the X-ray microanalysis system using the attached software. The whole area of the image taken in (500×) is designated to perform elemental analysis. Next, only three elements C, O and Al are selected from the detected elements, and calculation is performed for quantitation. The Al atomic concentration obtained at this time is acquired as the atomic concentration of aluminum of the present disclosure. In these operations above, the outermost surface of the sample is measured at any 30 points for measurement. The arithmetic average of the data on the atomic concentrations of aluminum obtained is determined. This average is defined as the atomic concentration of aluminum of the present disclosure.

[Formation of Surface Layer]

An electronically conductive substance or an ionically conductive substance can be used to impart appropriate electro-conductivity to the surface layer. As the conductive substance, the same materials can be used in the same compounding amount as mentioned in the elastic layer.

The surface layer can further contain a crosslinking agent, a plasticizer, a filler, an extender, a vulcanizing agent, a vulcanizing aid, a crosslinking aid, an antioxidant, an anti-aging agent, a treatment aid, and a leveling agent in the ranges not inhibiting the function of the surface layer. Moreover, if the surface layer needs surface roughness, fine particles can be added to impart roughness to the surface layer. Specifically, resin fine particles of polyurethane resins, polyester resins, polyether resins, polyamide resins, acrylic resins, and polycarbonate resins can be used. The fine particles can have a volume average particle diameter of 1.0 μm or more and 30 μm or less to give an appropriate surface roughness to the surface layer. The surface roughness (ten-point height of irregularities) Rzjis formed by the fine particles can be 0.1 μm or more and 20 μm or less to appropriately control the toner transfer amount. Rzjis refers to the value determined according to JIS B0601 (1994).

The surface layer can be formed by any method without particular limitation. Forming method by coating of a liquid coating material can be used. For example, the surface layer can be formed by dispersing and mixing materials for a surface layer in a solvent to prepare a coating material, applying the coating material onto an elastic layer, and solidifying the coating by drying or curing the coating by heating. A polar solvent can be used as the solvent in view of the wettability to the alumina particles. For example, among alcohols, such as methanol, ethanol, and n-propanols; ketones, such as acetone, methyl ethyl ketone, and methyl isobutyl ketone; and esters, such as methyl acetate and ethyl acetate, one or more solvents having high miscibility with other materials can be used. Moreover, in the preparation of the coating material, the solid content can be freely adjusted according to the amount of the solvent(s) mixed. The solid content can be 20% by mass or more and 40% by mass or less in terms of filling the resin into the gaps between the alumina particles. The dispersion mixing can be performed with a known dispersing apparatus using beads, such as a sand mill, a paint shaker, DYNO-MILL, or a pearl mill. Such a coating material prepared through dispersion mixing of the materials for a surface layer enables the resin to be uniformly introduced between the alumina particles, and can prevent drop-off of the alumina particles after long-term use of the developing member. Moreover, a coating method, such as immersion coating, ring coating, spray coating, or roll coating, can be used.

[Surface Treatment]

The surface layer formed by the method above can be subjected to a surface treatment to remove the resin on the outermost surface. Thereby, a plurality of protrusions containing a plurality of alumina particles and the resin can be formed on the outermost surface of the surface layer, and part or all of the alumina particles contained in each of the protrusions can be exposed at the surface of each of the protrusions. The presence/absence of the alumina particles exposed at the protrusions can be verified with a time-of-flight secondary ion mass spectrometry (TOF-SIMS).

Any surface treatment method can be used without particular limitation. Irradiation with ultraviolet light from a low pressure mercury lamp, laser etching, sand blasting, and chemical etching using an agent, such as hydrofluoric acid, can be used. Particularly irradiation with ultraviolet light from a low pressure mercury lamp can be used because formation of a plurality of protrusions containing plurality of alumina particles and the resin component and control of exposure of the alumina particles are facilitated through adjustment of the irradiation conditions.

[Thickness of Surface Layer]

The surface layer preferably has a thickness in the range of 0.005 mm or more and 0.1 mm or less. The thickness is in the range of more preferably 0.008 mm or more and 0.03 mm or less. The thickness of the surface layer can be determined through observation of cross-sections of the developing member. Cross-sections of the developing member are cut out with a razor at three places in total, i.e., positions 1 cm from both ends in the longitudinal direction of the developing member and the center of the longitudinal direction. The cross-sections are observed with a digital microscope (trade name: VHX-5000, made by Keyence Corporation) at a magnification of 1000×. In each image obtained from the observation of these cross-sections, the thickness of the surface layer is measured at ten points. From the arithmetic average of the data obtained from the measurement at the thirty points in total, the thickness of the surface layer can be calculated.

[Electrophotographic Process Cartridge and Electrophotographic Image Forming Apparatus]

Figure 3:
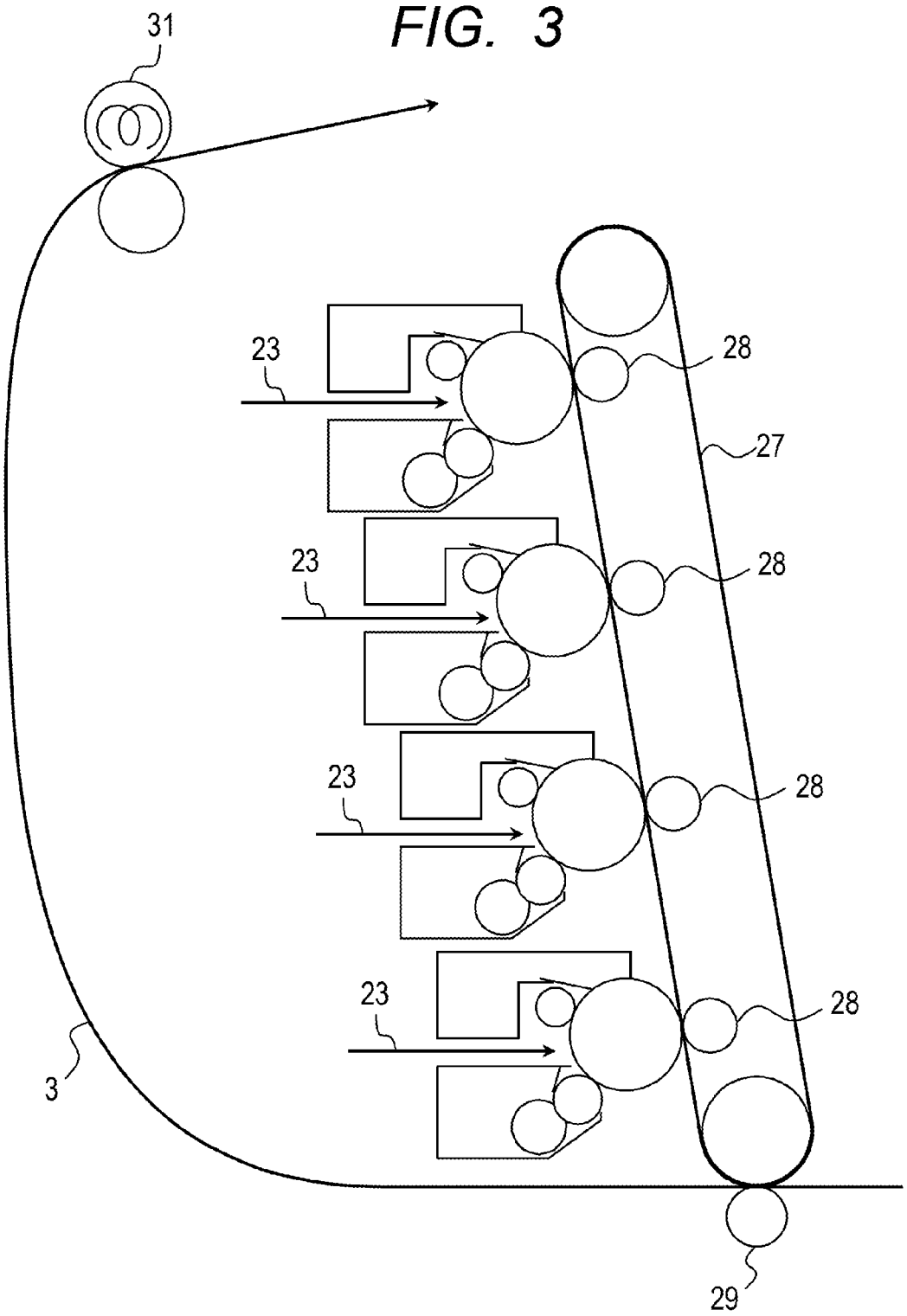
FIG. 3 is a schematic view illustrating an example of the electrophotographic image forming apparatus according to the present disclosure.

The electrophotographic image forming apparatus according to the present disclosure includes an image carrier for carrying an electrostatic latent image, a charging apparatus for primarily charging the image carrier, an exposing apparatus for forming an electrostatic latent image on the image carrier primarily charged, a developing member for developing the electrostatic latent image with a toner to form a toner image, and a transfer apparatus for transferring the toner image onto a transfer material. FIG. 3 is a sectional view illustrating an outline of the electrophotographic image forming apparatus according to the present disclosure.

Figure 4:
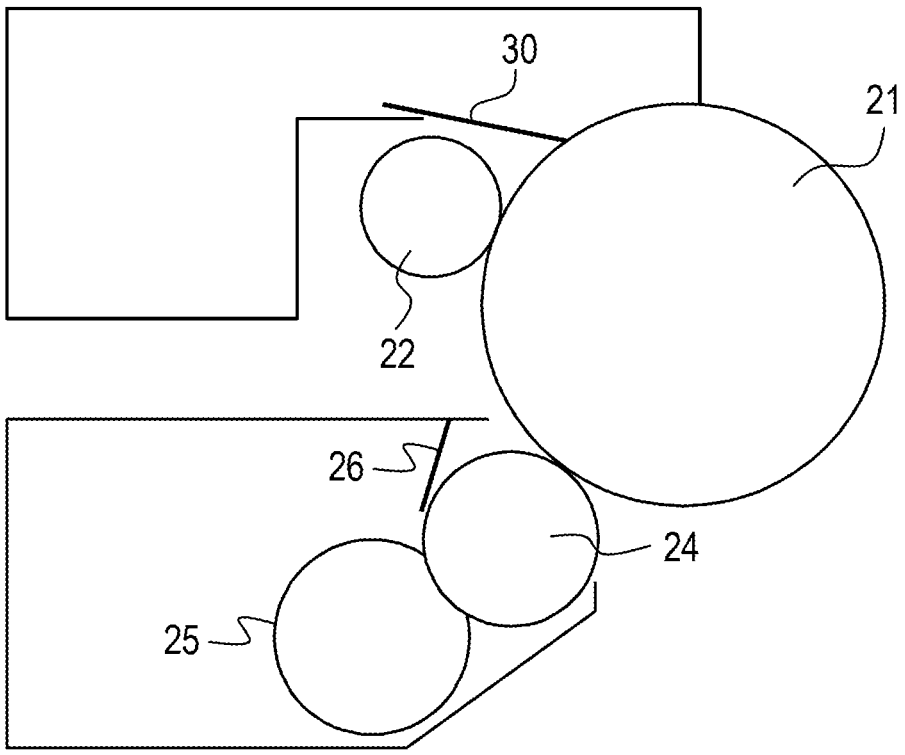
FIG. 4 is a schematic view illustrating an example of the electrophotographic process cartridge according to the present disclosure.

FIG. 4 is an enlarged sectional view of a process cartridge to be mounted on the electrophotographic image forming apparatus of FIG. 3. The process cartridge includes an image carrier 21, such as a photosensitive drum, a charging apparatus including a charging member 22, a developing apparatus including a developing member 24, and a cleaning apparatus including a cleaning member 30, which are incorporated in the process cartridge. The process cartridge is detachably mountable on the main body of the electrophotographic image forming apparatus of FIG. 3.

The image carrier 21 is uniformly charged (primarily charged) by the charging member 22 connected to a bias power supply not illustrated. The charging potential of the image carrier 21 at this time is −800 V or more and −400 V or less. Next, the image carrier 21 is irradiated with exposing light 23 for writing an electrostatic latent image, which is emitted from an exposing apparatus not illustrated. An electrostatic latent image is thereby formed on the surface of the image carrier 21. Any of LED light and laser light can be used as the exposing light 23. The surface potential of the image carrier 21 exposed to the light is −200 V or more and −100 V or less.

Next, a toner negatively charged by the developing member 24 is given to the electrostatic latent image (developed) to form a toner image on the image carrier 21. The electrostatic latent image is thereby converted into a visible image. At this time, a voltage of −500 V or more and −300 V or less is applied to the developing member 24 with the bias power supply not illustrated. The developing member 24 is in contact with the image carrier 21 in a nip width of 0.5 mm or more and 3 mm or less. In the process cartridge according to the present disclosure, a toner feeding roller 25 is in rotatable contact with the developing member 24 in a place located forward in the rotational direction of the developing member 24 with respect to the contact portion between a developing blade 26 as a toner regulating member and the developing member 24.

The toner image developed on the image carrier 21 is primarily transferred onto an intermediate transfer belt 27. The rear surface of the intermediate transfer belt 27 is in contact with the primary transfer member 28. A voltage of +100 V or more and +1500 V or less is applied to the primary transfer member 28 to primarily transfer the toner image having negative polarity from the image carrier 21 onto the intermediate transfer belt 27. The primary transfer member 28 may be in the form of a roller or a blade.

When the electrophotographic image forming apparatus is a full-color image forming apparatus, these charging, exposing, developing, and primary transfer steps should be performed for each of yellow, cyan, magenta, and black colors. Therefore, in the electrophotographic image forming apparatus illustrated in FIG. 3, four process cartridges in total including the corresponding toners are detachably mounted on the main body of the electrophotographic image forming apparatus. The charging, exposing, developing, and primary transfer steps are sequentially executed at predetermined time intervals to layer four toner images on the intermediate transfer belt 27 to express a full-color image.

The toner image on the intermediate transfer belt 27 is conveyed to a position facing a secondary transfer member 29 with rotation of the intermediate transfer belt 27. A recording sheet is conveyed to the position between the intermediate transfer belt 27 and the secondary transfer member 29 in a predetermined timing through a conveying route 32 for the recording sheet. The toner image on the intermediate transfer belt 27 is transferred onto the recording sheet through application of a secondary transfer bias to the secondary transfer member 29. At this time, the bias voltage applied to the secondary transfer member 29 is +1000 V or more and +4000 V or less. The recording sheet onto which the toner image is transferred by the secondary transfer member 29 is conveyed to the fixing apparatus 31. The toner image on the recording sheet is melted, and is fixed on the recording sheet. The recording sheet is then discharged from the electrophotographic image forming apparatus to the outside. The print operation is terminated.

A residual toner on the image carrier 21, which is not transferred from the image carrier 21 to the intermediate transfer belt 27 is scraped off by a cleaning member 30 for cleaning the surface of the image carrier 21. The surface of the image carrier 21 is thereby cleaned.

One aspect of the present disclosure can provide a developing member which can retain the ability to impart triboelectric charge to developers even if images are printed on a large number of sheets after long-term use of the developing member, and can output high-quality images in which fogging is reduced at high level. Moreover, one aspect of the present disclosure can provide an electrophotographic process cartridge and an electrophotographic image forming apparatus which can form high-quality electrophotographic images in which fogging is reduced at high level, because the triboelectric charge imparting ability of the developing member is retained after long-term use of the developing member.

EXAMPLES

The present disclosure will be described in more detail by way of specific Examples. These Examples should not be construed as a limitation on the technical range of the present disclosure implemented as a developing member.

The materials shown in Table 1 were prepared as materials for forming surface layers according to Examples and Comparative Examples.

TABLE 1

| Material for forming surface layer No. | Material | Details of material |
|---|---|---|
| 1 | Alumina dispersion | Trade name: NANOBYK-3610; made by BYK Japan K.K. (Physical properties of alumina: Average particle diameter: 20.7 nm, Coefficient of variation of particle diameter distribution: 0.205) |
| 2 | Alumina dispersion | Trade name: NANOBYK-3601, made by BYK Japan K.K. (Physical properties of alumina: Average particle diameter: 40.2 nm, Coefficient of variation of particle diameter distribution: 0.204) |
| 3 | Alumina particle | Trade name: ASFP-20, made by Denka Company Limited (Physical properties of alumina: Average particle diameter: 82.5 nm, Coefficient of variation of particle diameter distribution: 0.610) |
| 4 | Alumina particle | Trade name: AO-502, made by Admatechs Company Limited (Physical properties of alumina: Average particle diameter: 133.2 nm, Coefficient of variation of particle diameter distribution: 0.652) |
| 5 | Alumina sol | Trade name: Alumina sol10A, made by Kawaken Fine Chemicals Co., Ltd. (Physical properties of alumina: Average particle diameter: 40.5 nm, Coefficient of variation of particle diameter distribution: 0.201) |
| 6 | Polyester polyol | Trade name: NIPPOLAN 3027, made by Tosoh Corporation |
| 7 | Isocyanate | Trade name: CORONATE 2233, made by Tosoh Corporation |
| 8 | Poly(methyl methacrylate) | made by Polysciences, Inc. (Weight average molecular weight Mw = 75000) |
| 9 | Poly(dimethylaminoethyl methacrylate) | made by Polysciences, Inc. (Weight average molecular weight MW = 200000) |
| 10 | Bis(trifluoromethanesulfonyl)imide lithium | made by KISHIDA CHEMICAL Co., Ltd. (Ionically conductive agent) |
| 11 | Urethane resin particle | Trade name: Art-pearl C-400, made by Negami Chemical Industrial Co., Ltd. |

The actually measured values of the average particle diameter and the coefficient of variation are shown for the alumina particles listed as the materials for forming a surface layer Nos. 1 to 5. These values were measured by the method described later in [Average particle diameter, coefficient of variation, and shape of particle] of <4-1. Observation with transmission electron microscope>.

Example 1

1. Preparation of Substrate

A primer (trade name: DY35-051, made by Dow Corning Toray Co., Ltd.) was applied onto a metal core having an outer diameter of 6 mm and a length of 279 mm, and made of SUS304. The workpiece was heated at a temperature of 150° C. for 20 minutes to prepare a substrate.

2. Formation of Elastic Layer

The substrate was concentrically placed in a cylindrical metal mold having an inner diameter of 12.0 mm. The materials for a conductive elastic layer shown in Table 2 were mixed with a trimix (trade name: TX-15, made by INOUE MANUFACTURING CO., LTD.) to prepare an addition silicone rubber composition. The composition was injected into the metal mold heated to a temperature of 115° C. After the composition was injected, the composition was molded by heating at a temperature of 120° C. for 10 minutes. The temperature was lowered to room temperature. The product was removed from the metal mold to obtain Elastic roller 1 including a conductive substrate, and a conductive elastic layer formed on the outer periphery of the substrate and having a thickness of 2.95 mm.

TABLE 2

| Materials | Parts by mass |
|---|---|
| Liquid dimethylpolysiloxane having two or more silicon atom-binding alkenyl groups in one molecule (trade name: SF3000E, viscosity: 10000 cP, vinyl group equivalent: 0.05 mmol/g, made by KCC Corporation) | 100 |
| Platinum catalyst (Trade name: SIP6832.2, made by Gelest. Inc.) | 0.048 |
| Dimethylpolysiloxane having two or more silicon atom-binding hydrogen atoms in one molecule (trade name: SP6000P, Si—H group equivalent: 15.5 mmol/g, made by KCC Corporation) | 0.5 |
| Carbon black (Trade name: TOKABLACK #7360SB, made by Tokai Carbon Co., Ltd.) | 6 |

3. Formation of Surface Layer

Four materials shown in Components (1) of Table 3 were mixed by stirring. Subsequently, the mixture was dissolved in methyl ethyl ketone (made by Sigma-Aldrich Corporation) such that the solid content was 30% by mass, and was mixed. The mixture was homogeneously dispersed with a sand mill. Methyl ethyl ketone was added to the mixed solution to adjust the solid content to 25% by mass. The materials shown in Components (2) of Table 3 were added to the mixed solution, and were dispersed by stirring with a ball mill to prepare a coating material for a surface layer. The masses shown in Table 3 are the masses of the solid contents of the materials.

Namely, each material in use was weighed such that the mass of the material excluding the mass of the solvent corresponded to the mass shown in the table.

TABLE 3

| | Material for forming surface layer No. | Parts by mass |
|---|---|---|
| Components (1) | No. 2 | 30 |
| | No. 6 | 50 |
| | No. 7 | 50 |
| | No. 10 | 2 |
| Components (2) | No. 11 | 15 |

Elastic roller 1 was immersed in the coating material to be coated with the coating material such that the thickness of the coating was about 15 μm. Subsequently, Elastic roller 1 was heated at a temperature of 130° C. for 60 minutes to dry and cure the coating. The coating was then irradiated with ultraviolet light. The coating was irradiated with ultraviolet light while the coated elastic roller was being rotated in the circumferential direction at 30 rpm. The irradiation was performed for 5 minutes using a low pressure mercury lamp (model: GLQ500 US/11, made by Harison Toshiba Lighting Corporation) with ultraviolet light having a wavelength of 254 nm and an intensity of 30 mW/cm$^2$ to prepare Developing roller 1.

4. Evaluation of Developing Roller

Developing roller 1 obtained was evaluated as follows.

<4-1. Observation with Transmission Electron Microscope>

The average particle diameter of the alumina particles and the coefficient of variation were evaluated through observation of the alumina particles in the surface layer of the developing member using a transmission electron microscope. The observation was performed by the following method. The surface of the developing roller was cut into an approximately 1 mm square, and was fixed to a sample base. The sample base having the sample fixed thereto was placed in a cryomicrotome (model: ULTRACUT-UCT, made by Leica Biosystems Nussloch GmbH) set at −150° C., and was cooled for about 10 minutes. A thin film was cut from the surface of the developing roller using a diamond knife preinstalled in the cryomicrotome. The thickness of the thin film was set at 40 nm. The machining speed was 1.0 mm/min.

The resulting thin film was recovered using a pair of tweezers, and was attached onto a grid mesh with a support membrane preliminarily set in the cryomicrotome. Subsequently, the grid mesh with a support membrane was extracted from the cryomicrotome. The temperature of the thin film was returned to normal temperature.

[Presence/Absence of Protrusions]

Observation with a transmission electron microscope was performed using a transmission electron microscope (model:

JEM-2800, made by JEOL, Ltd.) having an accelerating voltage of 200 kV in a TEM mode. Sites of the outermost surface of the developing roller were observed at a magnification of 100000× for observation to verify the presence/absence of protrusions on the surface of the developing roller and a plurality of alumina particles contained in the protrusions.

[Average Particle Diameter, Coefficient of Variation, and Shape of Particle]

Subsequently, 500 alumina particles were photographed at random at a magnification of 400000× for observation. The diameters of these particles were measured to determine the arithmetic average. The average particle diameter was thus calculated. In the measurement of the diameter of a particle, the average of the maximum long diameter Lm of the particle and the maximum width Wm orthogonal to the maximum long diameter was defined as the diameter of the particle. The average particle diameter was calculated using this value. Moreover, from the diameters of the 500 alumina particles photographed here and the average particle diameter $D_M$, the standard deviation a was calculated. The coefficient of variation was calculated from Calculation expression (2).

Furthermore, each of the aspect ratios of the photographed alumina particles was calculated from the maximum long diameter Lm of the particle and the maximum width Wm orthogonal to the maximum long diameter. Particles in which 95% or more of the total particles measured had an aspect ratio in the range of 1.0 or more and 1.1 or less were determined as spherical particles, and particles in which 95% or more of the total particles measured had an aspect ratio out of the range of 1.0 or more and 1.1 or less were determined as non-spherical particles. The aspect ratio was calculated from Calculation expression (1).

[Presence/Absence of Resin Between Alumina Particles]

Furthermore, portions between alumina particles of the protrusions on the surface of the developing roller were subjected to elemental analysis by EELS analysis using an EELS detector attached to the transmission electron microscope. The presence/absence of the resin among the alumina particles was verified by this elemental analysis.

The analysis was performed in the EFTEM mapping mode of carbon atoms and nitrogen atoms on the following conditions:

EFTEM magnification: 18500×,

Energy Offset: 300 eV,

Major edges: 284 eV,

Slit width: 20 eV, and

Exposure Time: 90 sec.

4-2. Measurement of Average Height Rc of Irregularities>

A 200× object lens was attached to a shape measurement laser microscope (trade name: VK-X100, made by Keyence Corporation), and the pitch for measurement in the Z-axis direction was set at 0.01 μm. Nine points on the surface of Developing roller 1 were photographed. The obtained data of the three-dimensional shapes at the nine points was analyzed with analysis software attached to the apparatus to determine the value of Rc. Specifically, an outline curve having a horizontal distance of 30 μm was selected for any ten points of the data of each of the three-dimensional shapes to confirm the average height Rc of the outline curve. This operation was performed on the three-dimensional shapes at the nine points to calculate the average of 90 Rc values in total. The average was defined as the Rc value of Developing roller 1.

<4-3. Measurement of Surface Atomic Concentration of Aluminum (Al %)>

The atomic concentration of aluminum (Al %) on the surface of Developing roller 1 was measured by the method described in [Measurement of atomic concentration].

<4-4. Observation of State of Alumina Exposed>

The exposure of alumina particles from the surfaces of the protrusions was confirmed by time-of-flight secondary ion mass spectrometry (TOF-SIMS). The surface of the developing roller was cut out (5 mm in length, 5 mm in width, and 1 mm in thickness) with a razor. The sample was set in a time-of-flight secondary ion mass spectrometer (made by ULVAC-PHI, INCORPORATED, TORIFTIV). A single area (300 μm square) was irradiated with a gold ion gun (30 kV, 200 μA) for 5 minutes to measure positive ions. From the resulting mass spectrum, the ratio (I/T) of the intensity (I) of mass number 27 derived from aluminum to the total ionic intensity (T) of mass numbers 0 to 1500 was calculated. This value (I/T) was defined as an exposed alumina index. It was determined that a value of (I/T) of 0.01 or more indicated that alumina particles were exposed.

<4-5. Evaluation of Triboelectric Charge Imparting Ability of Developing Member>

Developing roller 1 was mounted on the process cartridge of the following color laser printer. The ability of Developing roller 1 to impart triboelectric charge to a toner was evaluated using a color laser printer (trade name: LBP7700C, made by Canon Inc.). The toner charging amount and the fogging value were evaluated. The cyan toner contained in the cyan print cartridge of LBP7700C was used as it was. The evaluation was performed according to the following procedure.

[Initial Evaluation]

Figure 5:
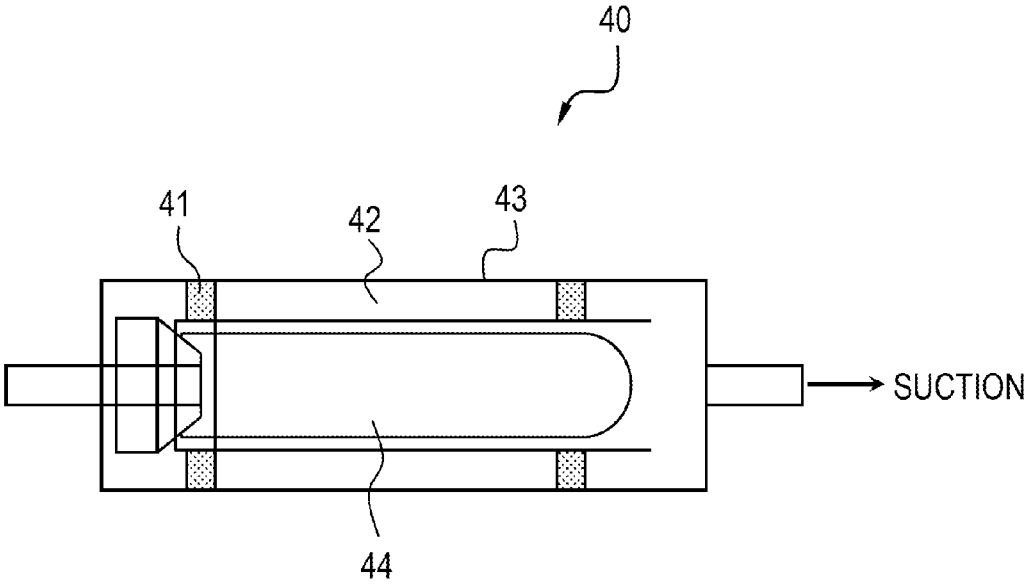
FIG. 5 is a schematic view illustrating a cylindrical filter for measuring the toner charging amount Q/M.

The cyan print cartridge was left to stand for 4 hours under an environment at a temperature of 30° C. and a relative humidity of 95%. Under the same environment, a solid white image having a coverage rate of 0% was output onto a recording sheet. The color laser printer was turned off during printing. At this time, the charging amount Q/M (μC/g) of the toner on the developing roller before passing through the nip between the photosensitive member and the developing roller was measured. Specifically, in the measurement of the charging amount of the toner, a Faraday cage 40 (illustrated in FIG. 5) including a double cylinder including an internal metal cylinder 42 and an external metal cylinder 43 having different axial diameters and coaxially disposed, and a filter (trade name: Thimble Filter No. 86R, 17×20×90, made by ADVANTEC Co., LTD.) 44 for further taking the toner into the internal cylinder 42 was used to air suction the toner on the developing roller. In the Faraday cage 40, the internal cylinder 42 is electrically insulated from the external cylinder 43 with an insulating member 41. When the toner is taken into the filter 44, electrostatic induction is caused by the charge amount Q of the toner. The induced charge amount Q was measured with a Coulomb meter made by Keithley Instruments, Inc., KEITHLEY 616 DIGITAL ELECTROMATER, and was divided by the mass M of the toner suctioned into the filter 44 to determine the charging amount Q/M (μC/g) of the toner. The above operation was repeatedly performed on a single developing roller three times to measure the charging amount of the toner three times. The arithmetic average of the three measured values was determined, and was defined as the toner charging amount of the developing roller.

Furthermore, when the printer was stopped while the solid white image was being output, a developer adhering onto the photosensitive member before transferred onto the intermediate transfer belt was removed with a tape. The reflectance $R_1$ of the tape was measured with a reflection densitometer (trade name: TC-6DS/A; made by Tokyo Denshoku Co., Ltd.). A reduced amount of the reflectance "$R_0$-$R_1$" (%) of the reflectance $R_1$ relative to the reflectance $R_0$ of an unused tape was calculated, and was defined as the fogging value. Based on these fogging values, evaluation was performed according to the following criteria:

Rank A: the fogging value is less than 1.5%.

Rank B: the fogging value is 1.5% or more and less than 3.0%.

Rank C: the fogging value is 3.0% or more and less than 4.5%.

Rank D: the fogging value is 4.5% or more and less than 6.0%.

Rank E: the fogging value is 6.0% or more.

[Evaluation after Long-Term Use]

Under an environment at a temperature of 30° C. and a relative humidity of 95%, an image having a coverage rate of 0.2% under the same environment was output onto 15000 recording sheets using the cyan print cartridge used in the initial evaluation. A solid white image having a coverage rate of 0% was then output onto a recording sheet using this cartridge. The color laser printer was turned off during printing. At this time, the charging amount Q/M (μC/g) of the toner on the developing roller before passing through the nip between the photosensitive member and the developing roller was measured by the same method as in the initial evaluation. Moreover, the difference between the charging amount in the initial evaluation and the charging amount after long-term use was calculated. Furthermore, the fogging value was also evaluated by the same method as in the initial evaluation.

Examples 2 to 8

The materials shown in Table 4 were used as the coating materials for a surface layer. In the alumina particles of Examples 3 to 8, their average particle diameters and coefficients of variation were adjusted using a mixture of two or more particulate aluminas. Except for these, Developing rollers 2 to 8 were prepared and evaluated by the same methods as in Example 1.

Examples 9 to 12

The materials shown in Table 4 were used as the coating materials for a surface layer. Developing rollers 9 to 12 were prepared and evaluated by the same method as in Example 1 except that the time of irradiation with ultraviolet light during formation of the surface layer was 30 seconds (Example 9), 10 minutes (Example 10), 20 minutes (Example 11), and 30 minutes (Example 12), respectively.

Examples 13 to 19

Developing rollers 13 to 19 were prepared and evaluated by the same method as in Example 1 except that materials shown in Table 4 were used as the coating materials for a surface layer.

TABLE 4

| Material for forming surface | Component (1) | | | | | | | | | | Component (2) |
|---|---|---|---|---|---|---|---|---|---|---|---|
| layer No. | No. 1 | No. 2 | No. 3 | No. 4 | No. 5 | No. 6 | No. 7 | No. 8 | No. 9 | No. 10 | No. 11 |
| Example 2 | 30 | — | — | — | — | 50 | 50 | — | — | 2 | 15 |
| Example 3 | 15 | 15 | — | — | — | 50 | 50 | — | — | 2 | 15 |
| Example 4 | — | 25 | 5 | — | — | 50 | 50 | — | — | 2 | 15 |
| Example 5 | — | 15 | 15 | — | — | 50 | 50 | — | — | 2 | 15 |
| Example 6 | 2 | 27 | 1 | — | — | 50 | 50 | — | — | 2 | 15 |
| Example 7 | 12 | 12 | 6 | — | — | 50 | 50 | — | — | 2 | 15 |
| Example 8 | 22.5 | — | — | 7.5 | — | 50 | 50 | — | — | 2 | 15 |
| Example 9 | — | 40 | — | — | — | 50 | 50 | — | — | 2 | 15 |
| Example 10 | — | 35 | — | — | — | 50 | 50 | — | — | 2 | 15 |
| Example 11 | — | 25 | — | — | — | 50 | 50 | — | — | 2 | 15 |
| Example 12 | — | 20 | — | — | — | 50 | 50 | — | — | 2 | 15 |
| Example 13 | — | — | — | — | 30 | 50 | 50 | — | — | 2 | 15 |
| Example 14 | — | 30 | — | — | — | — | — | 100 | — | 2 | 15 |
| Example 15 | — | 30 | — | — | — | — | — | — | 100 | 2 | 15 |
| Example 16 | — | 2 | — | — | — | 50 | 50 | — | — | 2 | 15 |
| Example 17 | — | 10 | — | — | — | 50 | 50 | — | — | 2 | 15 |
| Example 18 | — | 100 | — | — | — | 50 | 50 | — | — | 2 | 15 |
| Example 19 | — | 200 | — | — | — | 50 | 50 | — | — | 2 | 15 |

*In the table, numeric values indicate the solid content masses (parts by mass) of the materials.

Comparative Example 1

Elastic roller 21 was prepared in the same manner as in Example 1. The materials shown in Components (1) of Table 5 were mixed with stirring. Subsequently, the mixture was dissolved in methyl ethyl ketone (made by Sigma-Aldrich Corporation) such that the proportion of the total solid content was 30% by mass, and was mixed. The mixed solution was homogeneously dispersed with a sand mill. Methyl ethyl ketone was added to the mixed solution to adjust the solid content to 25% by mass. The material shown in Component (2) of Table 5 was added to the mixed solution, and was dispersed by stirring with a ball mill to prepare a coating material for an intermediate layer. Elastic roller 21 was immersed in the coating material to be coated with the coating material such that the thickness of the coating was about 15 μm. Subsequently, Elastic roller 21 was heated at a temperature of 130° C. for 60 minutes to prepare a roller with an intermediate layer.

Next, an alumina sol solution 520 (made by Nissan Chemical Industries, Ltd.) and ethanol were compounded at a volume ratio of 1:4, and were mixed with stirring to prepare a colloidal alumina solution. The roller with an intermediate layer was immersed in the colloidal alumina solution to be coated with the colloidal alumina solution. Developing roller 21 including an intermediate layer, and a surface layer having a thickness of 1.5 μm and formed on the intermediate layer was thereby prepared. Developing roller 21 was evaluated by the same method as in Example 1.

TABLE 5

| | Materials | Parts by mass |
|---|---|---|
| Components (1) | Polyester polyol (Trade name: NIPPOLAN 3027, made by Tosoh Corporation) | 50 |
| | Isocyanate(Trade name: CORONATE 2233, made by Tosoh Corporation) | 50 |
| | Carbon black (Trade name: MA230, made by Mitsubishi Chemical Corporation) | 25 |
| Component (2) | Polyurethane resin particles (Trade name: Art-pearl C400, made by Negami Chemical Industrial Co., Ltd.) | 15 |

Comparative Example 2

Developing roller 22 was prepared and evaluated by the same method as in Example 1 except that irradiation with ultraviolet light was not performed during formation of the surface layer.

Comparative Example 3

1. Preparation of Substrate

A substrate 23 was prepared by the same method as in Example 1.

2. Preparation of Developing Roller

The materials shown in Table 6 were kneaded with a Banbury mixer to form a rubber layer of 2.77 mm on the outer periphery of the substrate 23 with a rubber extruder. The workpiece was heated in an oven at 160° C. for one hour to vulcanize the rubber. Subsequently, the vulcanized rubber layer was subjected to traverse polishing, and then mirror polishing as finishing with a cylindrical polisher, and was washed with water. The surface of the resulting rubber roller was irradiated with ultraviolet to form an oxidized film layer on the surface of the rubber layer. The irradiation with ultraviolet light was performed with an ultraviolet light irradiator (made by SEN LIGHTS Corporation, "PL21-200"). The distance between the rubber roller and the ultraviolet light lamp was set at 10 cm. The surface of the rubber roller was irradiated every 90 degrees in the circumferential direction of the rubber roller for 5 minutes with ultraviolet light (wavelengths of 184.9 nm and 253.7 nm). The operation was repeated four times to form an oxidized film around the whole circumference of the roller. Developing roller 23 was thereby prepared, and was evaluated by the same method as in Example 1.

TABLE 6

| Materials | Parts by mass |
|---|---|
| Epichlorohydrin rubber (made by OSAKA SODA CO., LTD. "EPICHLOMER CG102") | 100 |
| Carbon black (made by Asahi Carbon Co., Ltd. "Asahi #15") | 40 |
| Alumina particle (made by Showa Denko K.K. "AL-160-SG-1") | 20 |
| Sulfur (made by Hayashi Pure Chemical Ind., Ltd.) | 0.5 |
| Ethylenethiourea (made by Kawaguchi Chemical Industry Co., Ltd. "Accel 22-S") | 1.4 |
| Hydrotalcite (made by Kyowa Chemical Corporation "DHT-4A-2") | 3 |

Comparative Example 4

Developing roller 24 was prepared and evaluated by the same method as in Example 1 except that the materials shown in Table 7 were used as the coating material for a surface layer.

TABLE 7

| | Materials | Parts by mass |
|---|---|---|
| Components (1) | Polyester polyol (Trade name: NIPPOLAN 3027, made by Tosoh Corporation) | 50 |
| | Isocyanate (Trade name: CORONATE 2233, made by Tosoh Corporation) | 50 |
| | Bis(trifluoromethanesulfonyl)imide lithium (made by KISHIDA CHEMICAL Co., Ltd.) | 2 |
| Component (2) | Polyurethane resin particles (Trade name: Art-pearl C400, made by Negami Chemical Industrial Co., Ltd.) | 15 |

The results of evaluation of Examples 1 to 19 and Comparative Examples 1 to 4 are shown in Table 8.

TABLE 8

| | Average particle diameter of alumina particles (nm) | Coefficient of variation of alumina particles | Average height of irregularities (μm) | Shape of alumina particle | Atomic concentration of aluminum Al (%) | Presence/absence of protrusions containing alumina particles | Presence/absence of exposed alumina | Presence/absence of resin between alumina particles | Toner charging amount Q/M (μC/g) Initial | After long-term use | Δ (Initial-After long-term use) | Determination of fogging Initial | After long-term use |
|---|---|---|---|---|---|---|---|---|---|---|---|---|---|
| Example 1 | 40.2 | 0.204 | 0.42 | Spherical | 4.04 | Present | Present | Present | 76.5 | 74.5 | 2.0 | A | A |
| Example 2 | 20.7 | 0.205 | 0.44 | Spherical | 4.08 | Present | Present | Present | 76.2 | 74.0 | 2.2 | A | A |
| Example 3 | 30.2 | 0.402 | 0.42 | Spherical | 4.07 | Present | Present | Present | 76.4 | 74.5 | 1.9 | A | A |
| Example 4 | 49.8 | 0.409 | 0.44 | Spherical | 4.09 | Present | Present | Present | 76.4 | 74.1 | 2.3 | A | A |
| Example 5 | 60.7 | 0.408 | 0.44 | Spherical | 4.07 | Present | Present | Present | 76.4 | 60.1 | 16.3 | A | B |
| Example 6 | 40.7 | 0.403 | 0.43 | Spherical | 4.06 | Present | Present | Present | 76.3 | 74.3 | 2.0 | A | A |
| Example 7 | 40.7 | 0.798 | 0.44 | Spherical | 4.01 | Present | Present | Present | 76.2 | 74.0 | 2.2 | A | A |
| Example 8 | 40.6 | 1.005 | 0.42 | Spherical | 4.07 | Present | Present | Present | 76.3 | 60.6 | 15.7 | A | B |

TABLE 8-continued

| | Average particle diameter of alumina particles (nm) | Coefficient of variation of alumina particles | Average height of irregu-larities (μm) | Shape of alumina particle | Atomic concen-tration of aluminum Al (%) | Presence/ absence of protrusions containing alumina particles | Presence/ absence of exposed alumina | Presence/ absence of resin between alumina particles | Toner charging amount Q/M (μC/g) Initial | After long-term use | Δ (Initial-After long-term use) | Determination of fogging Initial | After long-term use |
|---|---|---|---|---|---|---|---|---|---|---|---|---|---|
| Example 9 | 40.8 | 0.208 | 0.05 | Spherical | 4.04 | Present | Present | Present | 76.4 | 59.5 | 16.9 | A | C |
| Example 10 | 40.2 | 0.201 | 0.11 | Spherical | 4.01 | Present | Present | Present | 76.3 | 73.4 | 2.9 | A | A |
| Example 11 | 40.4 | 0.204 | 2.00 | Spherical | 4.04 | Present | Present | Present | 76.2 | 73.3 | 2.9 | A | A |
| Example 12 | 40.4 | 0.208 | 2.13 | Spherical | 4.02 | Present | Present | Present | 76.1 | 68.2 | 7.9 | A | B |
| Example 13 | 40.5 | 0.205 | 0.41 | Non-spherical | 4.02 | Present | Present | Present | 76.2 | 68.3 | 7.9 | A | B |
| Example 14 | 40.4 | 0.204 | 0.40 | Spherical | 4.05 | Present | Present | Present | 76.3 | 70.3 | 6.0 | A | B |
| Example 15 | 40.6 | 0.204 | 0.44 | Spherical | 4.08 | Present | Present | Present | 76.3 | 72.8 | 3.5 | A | A |
| Example 16 | 40.2 | 0.201 | 0.41 | Spherical | 0.35 | Present | Present | Present | 70.1 | 59.1 | 11.0 | A | C |
| Example 17 | 40.6 | 0.201 | 0.42 | Spherical | 1.59 | Present | Present | Present | 74.2 | 68.8 | 5.4 | A | B |
| Example 18 | 40.2 | 0.207 | 0.40 | Spherical | 9.80 | Present | Present | Present | 78.1 | 70.0 | 8.1 | A | B |
| Example 19 | 40.3 | 0.204 | 0.42 | Spherical | 12.00 | Present | Present | Present | 78.3 | 70.0 | 8.3 | A | B |
| Comparative Example 1 | 20.2 | 0.209 | 0.4 | Spherical | 7.5 | Present | Present | Absent | 65.0 | 32.1 | 32.9 | B | E |
| Comparative Example 2 | 40.5 | 0.201 | — | Spherical | 3 | Absent | Absent | Absent | 50.0 | 35.0 | 15.0 | C | E |
| Comparative Example 3 | 532.1 | 1.205 | — | Non-spherical | 2 | Absent | Absent | Absent | 49.9 | 34.8 | 15.1 | D | E |
| Comparative Example 4 | — | — | — | — | — | Absent | Absent | Absent | 45.1 | 27.3 | 17.8 | E | E |

[Discussion of Results of Evaluation]

All of the developing rollers in Examples 1 to 19 contained the alumina particles and the resin components in their surface layers, and had a plurality of protrusions on the surfaces of the surface layers. Moreover, each of the protrusions contained plurality of alumina particles, and the alumina particles contained in the protrusions were exposed at the surfaces of the protrusions. The resin was interposed among the plurality of alumina particles contained in each of the protrusions. All of the developing rollers in Examples 1 to 19 had a high ability to impart triboelectric charge to the toner even after long-term use of the developing rollers. Moreover, with this high triboelectric charge imparting ability, these developing rollers also had good results in the determination of fogging even after long-term use.

In Examples 1 to 4, 6, and 7, the alumina particles have an average particle diameter of 20 nm or more and 50 nm or less, and a coefficient of variation in the diameter of the alumina particle of 0.2 or more and 0.8 or less. With such an average particle diameter and coefficient of variation in the particle diameter, drop-off of the alumina particles are reduced at high level, and the alumina particles are uniformly exposed at the surfaces of the protrusions to exhibit a higher triboelectric charge imparting ability. Therefore, compared with Example 5 having an average particle diameter of more than 50 nm and Example 8 having a coefficient of variation of more than 0.80, these developing rollers had a high toner charging amount after long-term use. These developing rollers also had good results in the determination of fogging even after long-term use of the developing rollers.

In Examples 1, 10, and 11, the shapes of protrusions have an average height Rc of 0.10 μm or more and 2.00 μm or less. Therefore, compared with Example 9 having an average height Rc of less than 0.10 μm, or Example 12 having an average height Rc of more than 2.00 μm, these developing rollers had a high toner charging amount after long-term use. These developing rollers also had good results in the determination of fogging even after long-term use.

In the comparison of Example 13 with Example 1, Example 1 had a higher toner charging amount after long-term use. This higher toner charging amount led to a good result in the determination of fogging even after long-term use of the developing roller. It is considered that this is because spherical alumina particles in Example 1 prevent drop-off of the alumina particles after long-term use at a higher level.

In the comparison of Example 14 with Example 15, Example 15 containing a nitrogen-containing resin poly (dimethylaminoethyl methacrylate) as the resin component had a higher toner charging amount after long-term use. This higher toner charging amount led to a good result in the determination of fogging even after long-term use of the developing roller. It is considered that this is because the interaction between nitrogen atoms in the nitrogen-containing resin and the alumina particles prevents drop-off of the alumina particles at a higher level. Furthermore, in the comparison of Example 15 with Example 1, Example 1 containing a polyurethane resin as the resin component retains a higher toner charging amount after long-term use of the developing member. It is considered that this is because use of the polyurethane resin as the resin component diffuses external stress to prevent drop-off of the alumina particles at a higher level.

The atomic concentration of aluminum at the surface layer was in the range of 1.50 atomic % or more and 10.0 atomic % or less in Examples 1, 17 and 18, while the atomic concentration of aluminum at the surface of the surface layer was less than 1.50 atomic % in Example 16. Therefore, these developing rollers had a higher toner charging amount after long-term use. This higher toner charging amount led to good results in the determination of fogging even after long-term use of the developing rollers. With respect to the toner charging amount, the difference between the initial value and the value after the long-term use (A) for Example 19 was slightly larger compared to that for Example 18. The toner charging amount after long-term use and the level of fogging in Example 19 were slightly inferior to those of Examples 1, 17 and 18. It is believed that this is because the atomic concentration of aluminum (Al %) in Example 19 was 10.0 or more, and thus the mechanical properties of the surface layer were slightly reduced. However, the mechanical properties were not problematic in practical use.

In Comparative Example 4 having a configuration in Example 1 excluding the alumina particles, the toner charging amount was low from the initial stage to after the long-term use, and the result in the determination of fogging was also low. Comparative Example 1 including alumina particles disposed on the surface had a high initial triboelectric charge imparting ability and a good result in the determination of fogging. However, the absence of resin among the alumina particles resulted in a low toner charging amount and a low rank in the determination of fogging after long-term use.

Because the surface layers of the developing rollers according to Comparative Examples 2 and 3 contained the alumina particles, compared with the developing roller according to Comparative Example 4, these developing rollers had a high initial toner charging amount and a better result in the determination of fogging. However, because the surfaces of the surface layers had no protrusions and the alumina particles were not exposed, these developing rollers had lower triboelectric charge imparting abilities and lower ranks in the determination of fogging compared with the developing rollers according to Examples.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-091000, filed Apr. 28, 2016, which is hereby incorporated by reference herein in its entirety.

What is claimed is:

1. A developing member comprising a substrate and a surface layer containing alumina particles and a resin, said surface layer having a thickness of 0.005 to 0.1 mm, the developing member having protrusions on the surface thereof, each of the protrusions containing the alumina particles, with part or all of the alumina particles contained in each of the protrusions being exposed at a surface of each of the protrusions, and the resin being interposed among the alumina particles contained in each of the protrusions, wherein the alumina particles have an average particle diameter of 20 to 50 nm, and have a coefficient of variation in a particle diameter distribution of 0.80 or less, the coefficient of variation being calculated from coefficient variation=(standard deviation of diameter $\sigma$)/(average particle diameter $D_m$, and the surface of the developing member has a mean height Rc resulting from the protrusions, as described in JIS B0601:2013, of 0.10 to 2.00 μm.

2. The developing member according to claim 1, wherein the alumina particles have a spherical shape.

3. The developing member according to claim 1, wherein the resin is a nitrogen-containing resin.

4. The developing member according to claim 1, wherein the resin is a polyurethane resin.

5. The developing member according to claim 1, wherein the surface of the developing member has an atomic concentration of aluminum of 1.50 to 10.0 atomic %, the atomic concentration being determined through photographing of an outermost surface of the developing member with a field emission scanning electron microscope, and elemental analysis of the photographed outermost surface with an X-ray microanalysis system.

6. An electrophotographic process cartridge detachably mountable on a main body of an electrophotographic apparatus comprising a developing member having a substrate and a surface layer containing alumina particles and a resin, said surface layer having a thickness of 0.005 to 0.1 mm, the developing member having a plurality of protrusions on a surface thereof, each of the protrusions containing a plurality of the alumina particles, with part or all of the plurality of the alumina particles contained in each of the protrusions being exposed at a surface of each of the protrusions, and the resin being interposed among the plurality of the alumina particles contained in each of the protrusions, wherein the alumina particles have an average particle diameter of 20 to 50 nm, and have a coefficient of variation in a particle diameter distribution of 0.80 or less, the coefficient of variation being calculated from coefficient variation=(standard deviation of diameter $\sigma$)/(average particle diameter $D_m$, and the surface of the developing member has a mean height Rc resulting from the protrusions, as described in JIS B0601:2013, of 0.10 to 2.00 μm.

7. An electrophotographic image forming apparatus, comprising:

an image carrier for carrying an electrostatic latent image;

a charging apparatus for primarily charging the image carrier;

an exposing apparatus for forming an electrostatic latent image on the image carrier primarily charged;

a developing member for developing the electrostatic latent image with a toner to form a toner image; and a transfer apparatus for transferring the toner image onto a transfer material, wherein the developing member includes a substrate and a surface layer containing alumina particles and a resin, said surface layer having a thickness of 0.005 to 0.1 mm, the developing member has protrusions on a surface thereof, each of the protrusions contains the alumina particles, with part or all of the alumina particles contained in each of the protrusions being exposed at a surface of each of the protrusions, and the resin being interposed among the alumina particles contained in each of the protrusions, wherein the alumina particles have an average particle diameter of 20 to 50 nm, and have a coefficient of variation in a particle diameter distribution of 0.80 or less, the coefficient of variation being calculated from coefficient variation=(standard deviation of diameter $\sigma$)/(average particle diameter $D_m$, and the surface of the developing member has a mean height Rc resulting from the protrusions, as described in JIS B0601:2013, of 0.10 to 2.00 μm.

* * * * *